United States Patent [19]

Gename

[11] 4,251,038

[45] Feb. 17, 1981

[54] HOSE REEL

[75] Inventor: John L. Gename, Naperville, Ill.

[73] Assignee: Popeil Brothers, Inc., Chicago, Ill.

[21] Appl. No.: 892,896

[22] Filed: Apr. 3, 1978

[51] Int. Cl.[3] ..... B65H 75/40

[52] U.S. Cl. ..... 242/86; 242/96

[58] Field of Search ..... 242/86, 86.1, 86.2, 242/86.3, 86.4, 96, 106, 105, 84.8, 68, 85, 60, 68.4; 137/355.19, 355.26, 355.27; 239/198, 199; 254/190

[56] References Cited

U.S. PATENT DOCUMENTS

| | | | |
|---|---|---|---|
| 597,100 | 1/1898 | Cliff | 137/355.19 |
| 1,199,790 | 10/1916 | Holcomb | 242/96 |
| 1,297,380 | 3/1919 | Marriott | 242/86 |
| 1,533,802 | 4/1925 | Johnson | 242/60 |
| 1,915,632 | 6/1933 | Marks | 242/86 |
| 2,642,312 | 6/1953 | Shine | 242/86 X |
| 2,869,800 | 1/1959 | Eden | 242/86 |
| 3,979,833 | 9/1976 | Grundman | 242/96 X |

*Primary Examiner*—John M. Jillions
*Attorney, Agent, or Firm*—Jack E. Dominik

[57] ABSTRACT

A hose reel is shown having a body portion with two sides which define a reel pocket therebetween. At one end a hand grip is provided, and at the remote end a pair of opposed rollers are located which serve to guide the hose and strip the hose. A crank having a crank axle lockingly secures a hose reel in the reel pocket. The reel itself has a central hub which is engaged by a spline on the crank handle. Radiating from the hub is a spider-like assembly which engages one end of the hose fitting and causes a flat type hose to assume a circular configuration when the reel is full.

27 Claims, 10 Drawing Figures

FIG. 5
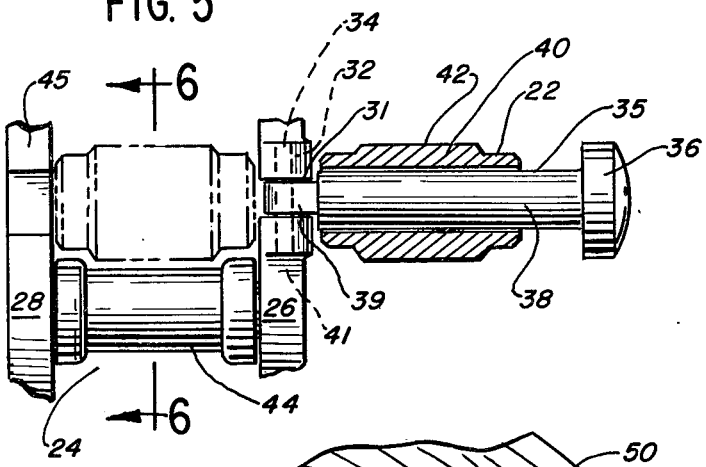
FIG. 6
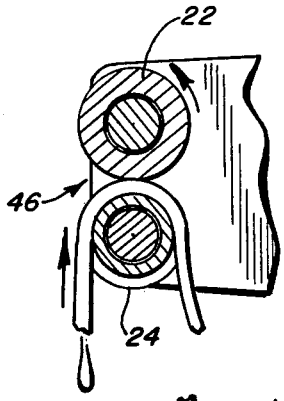
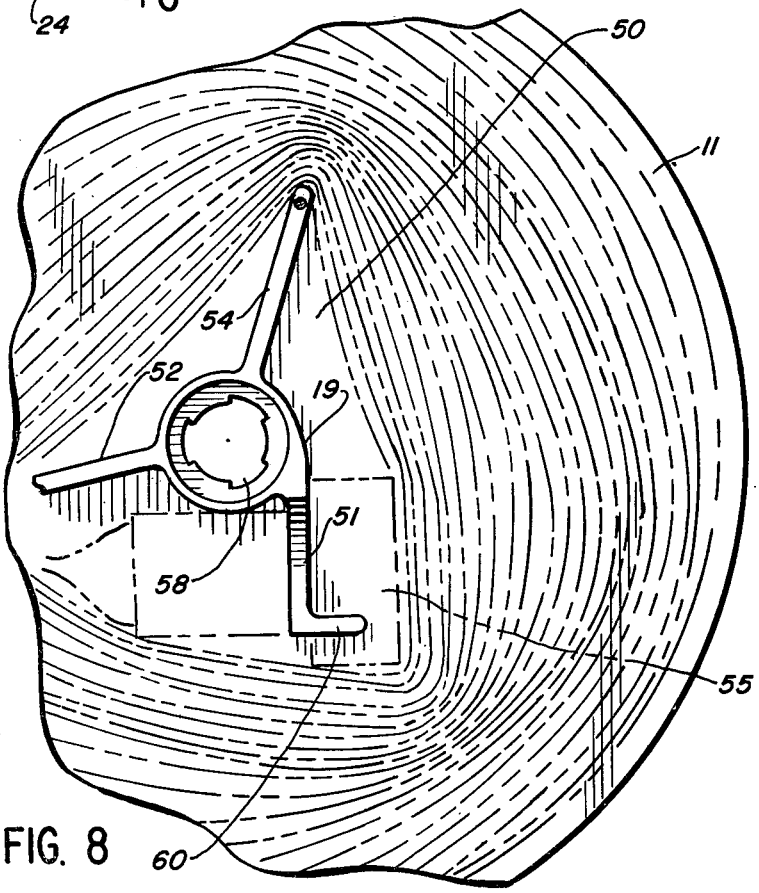
FIG. 8
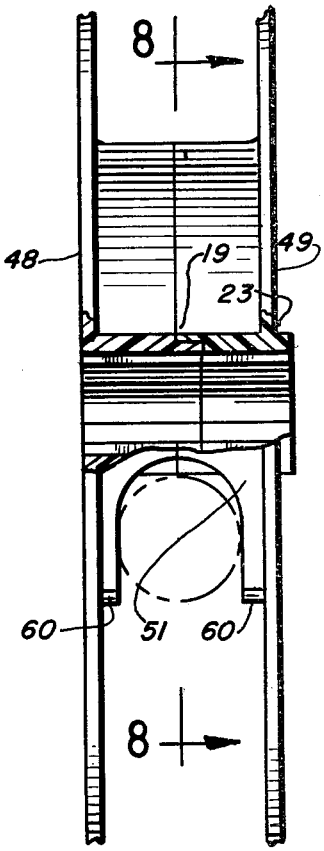
FIG. 7
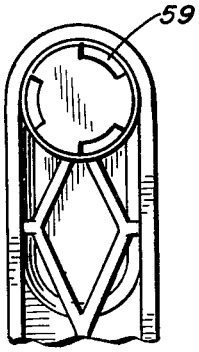
FIG. 9
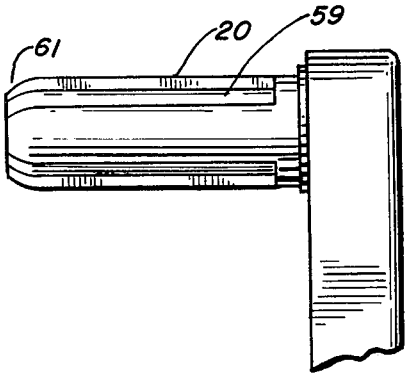
FIG. 10

HOSE REEL

FIELD OF INVENTION

The invention is directed to the subject matter of reeling a garden hose, and more particularly storage of the same on a reel. In addition, the field of invention is directed to a hand held hose reel which can be stored in a small space such as a kitchen drawer, glove compartment of a car, storage locker on a boat, camper, or trailer.

SUMMARY OF THE PRIOR ART

Exemplary of the prior art is U.S. Pat. No. 3,779,478 classified in U.S. Class 242, subclass 86. The structure suffers the disadvantage of not being able to strip the hose while it is being rewound, and further there is no way it can be readily wound without securing the unit to a wall or flat surface. Related earlier efforts at hose reels are shown in U.S. Pat. Nos. 3,169,432 and 3,330,498. In these patents as well as U.S. Pat. No. 3,184,180, the units disclosed are invariably secured to some structure, and are not freely supported. Furthermore, it becomes apparent upon a review of the disclosures that they are large and not susceptible of convenient storage. Additional efforts at winding garden hose and the like appear in Canadian Pat. Nos. 689,553 and 861,935, as well as British Pat. No. 532,978.

SUMMARY OF INVENTION

The present invention is directed to a hand held hose reel with a body having a hand grip portion at one end, a reel pocket in the center, and a guide assembly at the end remote from the hand grip. The guide assembly in the preferred embodiment has opposed rollers defining a stripper space therebetween which strips the hose when the same is cranked onto the reel by means of a hand crank. Provision is made for right handed or left handed use of a crank, and a guide is provided to insure correct orientation and centering of the reel.

In view of the foregoing, it is a principal object of the present invention to provide a hand held hose reel capable of storing a practical length of hose which, when the hose is wound on the reel, will self-strip the hose of excess moisture.

A related object of the present invention is to provide a hand held hose reel which is extremely compact, and permits storage in such confined places as car glove compartments, tool drawers, boats, campers, trailers, small apartments and the like.

Still another object of the present invention is to provide a hand held hose reel in which the hose itself can be removed on its own reel, and another hose installed. For example, one hose will serve as the ordinary conduit of water, and another similar size hose when perforated is used as a soaker.

Still another object of the present invention is to provide a hand held hose reel which can be readily adapted to the left handed or right handed user. A further related object of the invention is directed to a guide which insures proper orientation and centering of the reel.

In addition, a key object of the present invention is to provide a hand held hose reel with all of the above objectives obtained in an environment which is relatively inexpensive to manufacture, and has very few individual piece parts.

DESCRIPTION OF DRAWINGS

Further objects and advantages of the present invention will become apparent as the following description of an illustrative embodiment proceeds, taken in conjunction with the accompanying drawings in which:

FIG. 5 is an enlarged diagrammatic broken view of the front portion of the hose reel showing in particular detail the stripper guide assembly.

FIG. 6 is a transverse sectional view taken along section 6—6 of FIG. 6.

FIG. 7 is a front elevation in enlarged scale of the reel portion of the hand held hose reel showing in partial section the hub construction, and the location of the hose fitting in phantom lines.

FIG. 8 is a front elevation of the reel taken through section line 8—8 of FIG. 7, illustrating how the hose spider spreads the hose interiorly and supports the hose fitting to result in a substantial circular wind of the hose when the reel is full.

FIG. 9 is a broken view of the crank handle showing its axle portion.

FIG. 10 is a side view of the crank in the same scale as FIG. 10 showing the crank axle also.

DESCRIPTION OF A PREFERRED EMBODIMENT

Figure 1:
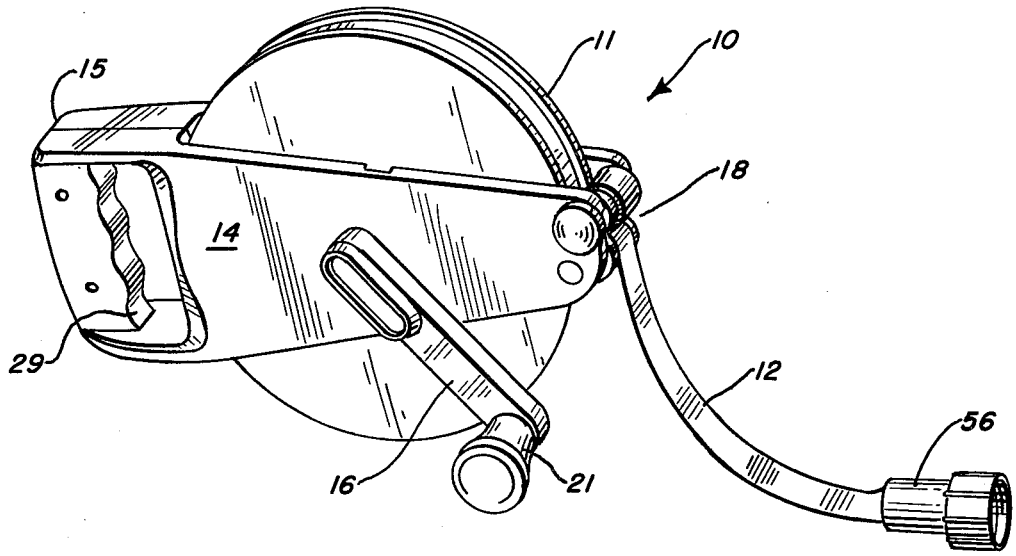
FIG. 1 is a perspective view of the subject hose reel.
Figure 2:
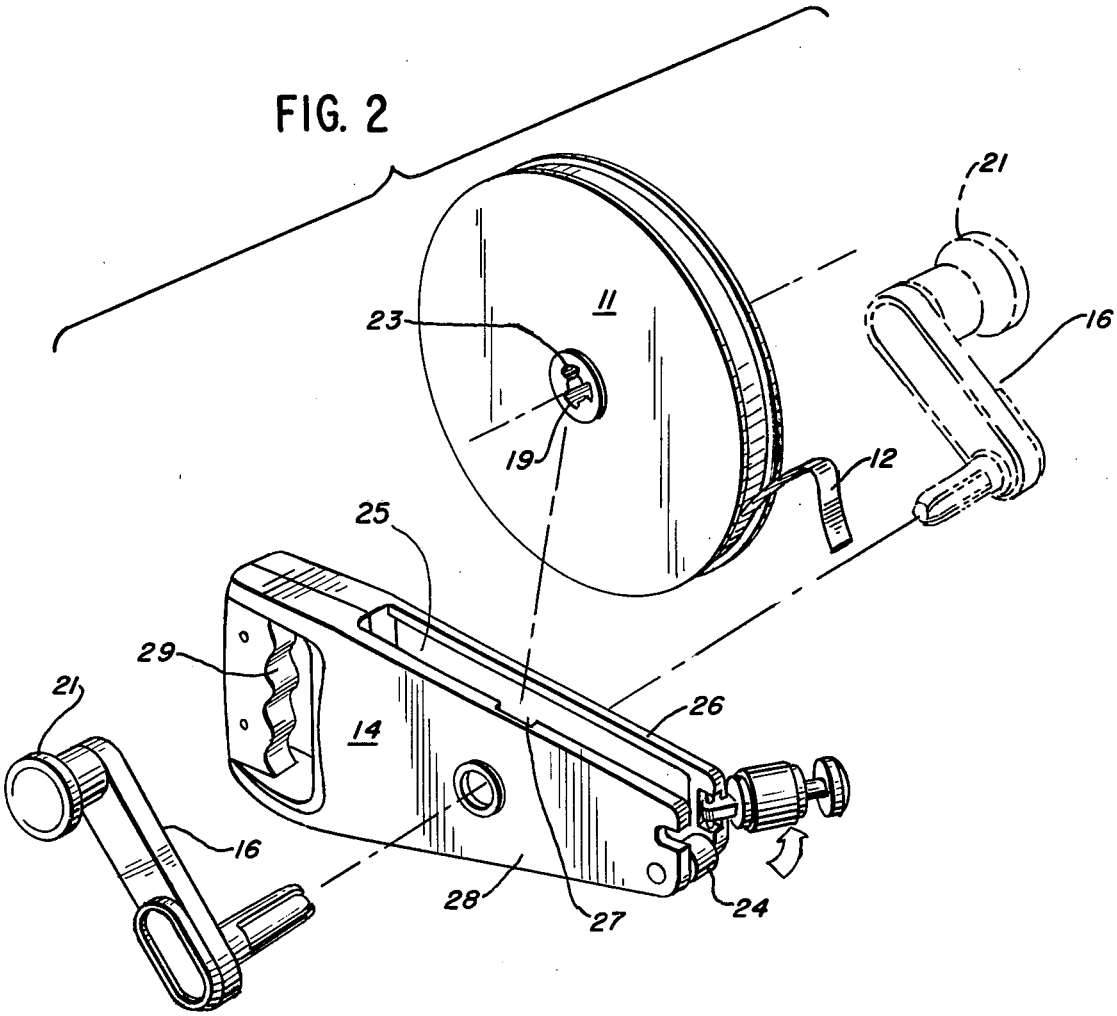
FIG. 2 is an exploded view of the subject hose reel showing the hand crank, body, and reel separated.

The subject hose reel 10 shown in FIG. 1 of the drawings includes an insertable reel 11 with hose 12 which is wound in the reel 11. The body 14 of the hose reel 10 has a hand grip portion 15 at one end, means for removably mounting a crank 16 at a midportion and coaxial with the reel 11, and terminates at the end opposite the hand grip 15 with a stripper guide assembly 18. As seen in FIG. 2, the reel hub 19 is engaged by the crank axle 20. After the crank axle 20 is slipped into the reel hub 19 while the reel is in the correct location, the crank is rotated by means of the crank handle 21. As shown in phantom lines, the crank 16 can be inserted through either side thus accommodating left or right handed persons or positions.

The action of turning the crank to wind the hose 12 on the reel 11 causes a coaction between the strip roller 22 and the fixed roller 24. As noted in FIG. 2, the reel 11 is inserted into the reel pocket 25, defined between the left side 26 and the right side 28 of the body 14. The reel hub extension 23 is inserted into the reel hub guide slot 27 in the right side 28 of the body 14. The bottom of the slot 27 cradles the reel hub 19 for the insertion of the crank 16 from either side.

The hose 12 rolls over the top of the fixed roller 24 when the reel is in the reel pocket 25. The strip roller 22, which is the upper roller, is then rotated into the position as shown in FIG. 1, and the two opposed rollers coact to squeeze the moisture out of the hose, particularly as shown in the enlarged sectional view of FIG. 6. To make the unit readily operated by one person, and highly portable requiring no support such as a stand, or attachment to a wall or the like, the hand grip 15 is closed and is provided with a plurality of finger grooves on the inside which can be grasped by either the right hand or the left hand of the user.

Figure 3:
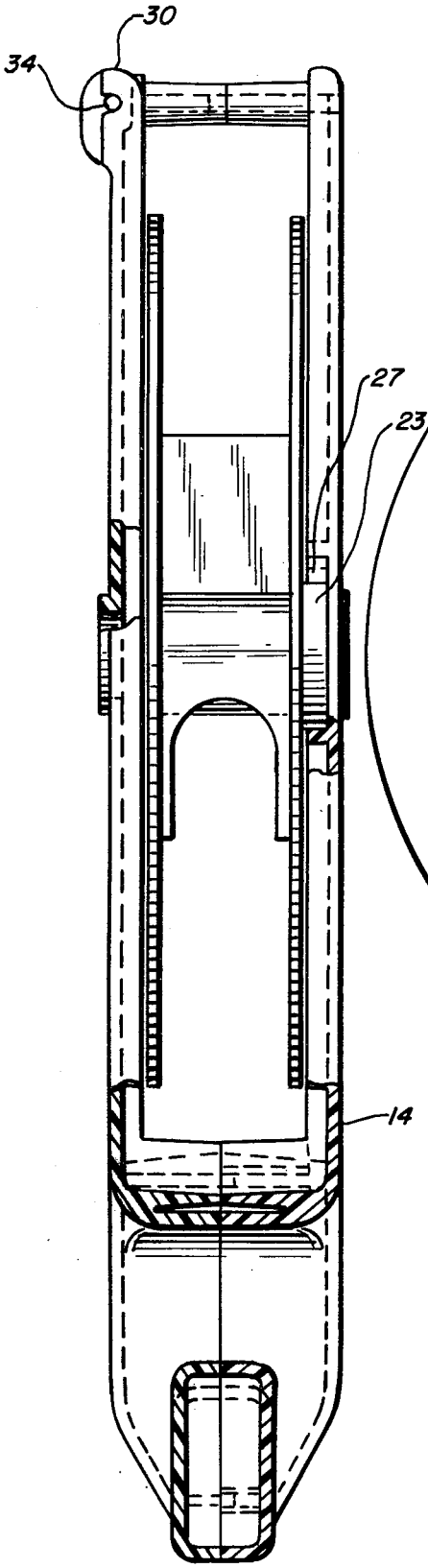
FIG. 3 is a bottom view of the hose reel in partial section, taken along section lines 3—3 of FIG. 4.
Figure 4:
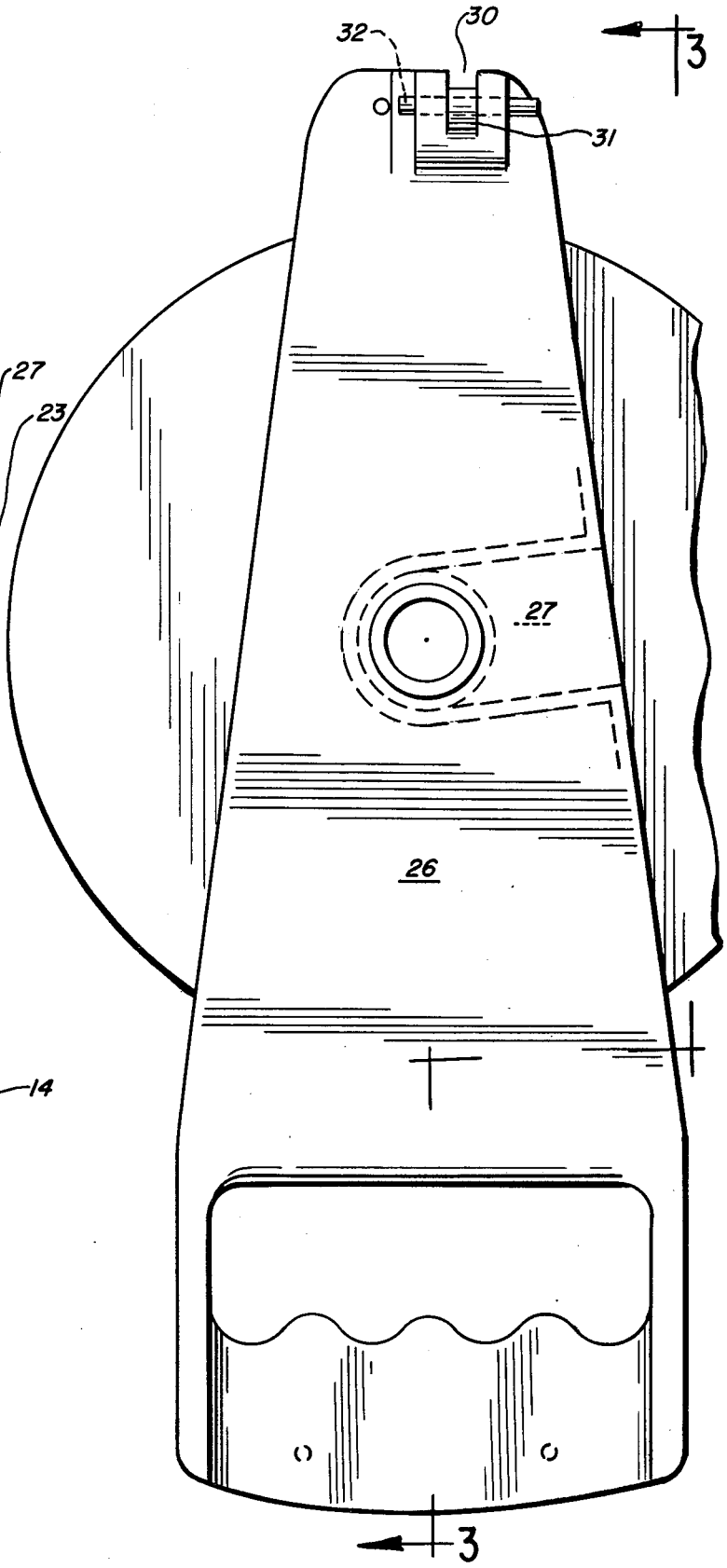
FIG. 4 is a front elevation of the left side of the subject hose reel in the same scale as FIG. 3.

The mounting assembly 30 for the strip roller 22 is shown in smaller scale on FIGS. 3 and 4, but best illustrated in enlarged broken scale on FIG. 5. There it will be seen that the slot 31 in the mount 30 includes a transverse pivot bore 32 intended to and receiving a pivot pin 34 for the strip roller 22. The main pin 35 for the strip roller 22 has a head 36 at one end, a shaft 38 extending from that end, and a pivot flat 39 at the opposite end of the head 36 for receiving the pivot pin 34. In between the pivot flat 39 and the head 36, space is provided for the roller 40 which rolls on the shaft 38 of the pin 35. The pivot bore 41 in the pivot flat 39 pivotally secures the entire strip roller assembly 22 for rotation. Here it should be noted that the roller 40 has a pressure sleeve 42 at its midportion which is positioned opposite the pressure groove 44 of the fixed roller 24.

When the strip roller assembly 22 is moved into the operating position as shown in phantom lines in FIG. 5, that portion of the shaft 38 adjacent the head 36 engages in the latch slot 45 in the side 28. In this configuration a strip slot 46 is defined between the opposed strip roller 40 and fixed roller 24 specifically by the pressure sleeve 42 of the strip roller 40 and the pressure groove 44 of the fixed roller 24. This action is depicted also in FIG. 6 where it will be seen that the action of the hose 12 riding over the fixed roller 24 as opposed by the strip roller assembly 22 results in expressing water outwardly from the hose 12 as the hose reversely bends itself going over the top of the fixed roller 24 and then on to the reel 11.

The reel 11, as shown in FIG. 7, contemplates a pair of opposed side plates 48, 49 which are secured to the reel hub 19, and contained therebetween is a hose spider 50. The hose spider 50 includes a fitting crotch 51 (see particularly FIG. 7) which is followed by a lead web 52 (see FIG. 8) and a center web 54. In operation the male fitting 55 of the hose 12 is secured within the fitting crotch 51, and as the hose is wound about the hose spider 50, the configuration changes from substantially equalaterally triangular to circular as the periphery of the reel 11 is approached. The female fitting 56, as shown in FIG. 1, does not pass through the stripper guide 18, but terminates short of that configuration with the water thoroughly expressed from the interior of the hose by means of the action of the stripper guide 18 and its strip roller assembly 22 coacting with the fixed roller 24 as described above and illustrated graphically in FIG. 6.

Noting again FIG. 8, in order to achieve a smooth wind of the hose 12 about the hose spider 50, the effective terminals of the lead web 52, the center web 54, and the corner of the male fitting 55 are on 120° spacing, and substantially equilateral triangular locations. This latter is achieved by providing the crotch 51 at a different angle to the reel hub 19, but securing the male fitting 55 by means of the crotch feet 60 in a location so that its lower corner is in fact on substantially an equilateral triangular relationship with the ends of the webs 52, 54. While the symmetry of the webs and fitting is shown as an equilateral triangle, also a square with an additional web will achieve comparable results.

The crank 16, as shown in FIGS. 9 and 10, has not only the crank axle 20 for engagement with the reel 11, but a hub spline 58 is provided interiorly of the hub 19 for coacting, removable, and reversible engagement with the crank axle spline 59. The crank axle 20 terminates in a stub nose 61 for one sided engagement in the left side 26 of the body 16, but because of a similar opening of identical size on both sides of the body 26, 28 reversal of the crank 16 is possible to accommodate a left handed user as well as a right handed user, or alternatively render the hand held hose reel 10 more adaptable to a particular confined space.

In summary, a hand held hose reel 10 has been disclosed and described which has a removable reel 11 and hose 12 which, in a commercial embodiment wherein the reel has a diameter of 8 inches will contain 50 feet of hose. The reel 11 is readily removed from the reel pocket 25 when the crank 16 is removed from the reel hub 19. The stripper assembly 22 serves not only to guide the hose while it is being reeled onto the reel 11, but also to strip the same of excess moisture. Upon unrolling the hose, the strip roller assembly may be retracted for increased speed, or retained in the position secured in the latch slot 45 at the option of the user. The entire unit, when assembled, without the crank, is only 8 inches high, 12 inches long, and 4 inches wide with the crank insert and even with the crank but without the hose, weighs only 1 pound. The additional weight of ½ pounds contributed by the 50 feet of hose and its male and female fittings still renders the unit lightweight, compact, and because the body parts as well as the reel may be molded from plastic, a real economy in construction results.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A hose reel comprising, in combination, a body having two elongate sides defining an uninterrupted top opening reel pocket laterally therebetween, a reel having two opposed parallel side plates spaced to nestingly receive a single width of hose and a central hub, a crank, means for securing the crank from a position adjacent one body side into the reel hub thereby securing the reel in the body reel pocket, a hand grip portion at one end of the body closing one end portion of the reel pocket, hose guide means at the end of the body remote from the hand grip and closing the other end portion of the reel pocket with a crank securing means therebetween, said hand grip, crank securing means, and hose guide means being all along a substantially straight line, the axis of grasp of the hand grip being substantially perpendicular to said straight line, said hose guide means including further means for disengaging for unwinding and re-engaging the same for rewinding the hose and expressing fluid therefrom, whereby a hose may be wound around the reel hub and guided by the guide means, and readily unwound by pulling the same along an axis the tension force of which is substantially coaxial with the axis of the hand grip, crank securing means, and the hose guide means.

2. In the hose reel of claim 1 above, said guide means comprising a pair of opposed rollers in spaced relationship, the space between the rollers being proportioned to rollingly and compressingly engage a hose for positioning on the hose reel, whereby the hose is stripped of excess water and a maximum amount of hose can be stored in a minimized circular portion of the interior of the hose reel.

3. In the hose reel of claim 1 above, connecting means on both sides of the hose reel hub to removably receive the crank, whereby the crank may be positioned on either side of the body portion for use in confined spaces and to adapt itself to a user who is either left-handed or right-handed.

4. In the hose reel of claim 1 above, said crank being removably secured to the reel central hub, whereby removing the crank permits removing the reel.

5. In the hose reel of claim 1 above, said guide means traversing the forward portion of the body being removable into a retracted configuration, said hub being secured in position interiorly of the body, and locking the same in place by means of a removably secured crank, whereby upon removing the crank and opening the guide means, the hose reel may be removed, and another hose reel inserted.

6. In the hose reel of claim 1, a spider assembly radiating from the reel hub, said assembly having two webs and a fitting crotch proportioned so that the web ends and the fitting crotch are on symmetrical centers, whereby the hose is secured in the crotch and wound to a circular configuration.

7. A hose reel comprising, in combination, a body having two sides defining a reel area therebetween, a reel having two opposed sides and a central hub, slot means in only one body side for securing the hose reel between the two side portions of the body, slot engaging means on one hub side proportioned to insure properly oriented insertion of the reel into the body slot means, crank means for rotating the hose reel, while secured within the body and the reel hub, means for guiding a hose to be wound upon the hose reel comprising a pair of opposed members both in frictional engagement with a hose wound on the reel, whereby upon rotating the crank while a hose is threaded interiorly of the hose reel, the means for guiding will permit the hose to be wound interiorly of the reel, and at the same time strip the hose of retained water and minimizing its size for storage.

8. In the hose reel of claim 7 above, connecting means on both sides of the hose reel hub to removably receive the crank, whereby the crank may be positioned on either side of the body portion for use in confined spaces and to adapt itself to a user who is either left-handed or right-handed.

9. In the hose reel of claim 7 above, said crank being removably secured to the reel central hub, whereby removing the crank permits removing the reel.

10. In the hose reel of claim 7 above, said guide means traversing the forward portion of the body being removable into a retracted configuration, said hub being secured in position interiorly of the body, and locking the same in place by means of a removably secured crank, whereby upon removing the crank and opening the guide means, the hose reel may be removed, and another hose reel inserted.

11. In the hose reel of claim 7, a spider assembly radiating from the reel hub, said assembly having two webs and a fitting crotch proportioned so that the web ends and the fitting are on symmetrical centers, whereby the hose is secured in the crotch and wound to a circular configuration.

12. In the hose reel of claim 7, a closed hand grip at an end of the body remote from the guiding means.

13. A hose reel comprising, in combination, a body having two sides defining an uninterrupted top opening reel pocket therebetween, a reel having two opposed sides spaced to receive a single width of hose and a central hub, an open ended fitting crotch adjacent the central hub to removably receive and secure one end fitting of the hose, a crank removably secured to the hub of the hose reel for rotating the same, a hand grip portion at one end of the body, hose guide and stripper means at the end of the body remote from the hand grip with the crank and hub oriented therebetween, whereby a user may hold the body by the grip portion and rotate the crank to wind a hose on the reel and then utilize the assemblage for storing the hose.

14. In the hose reel of claim 13 above, said guide and stripper means comprising a pair of opposed rollers in spaced relationship, the space between the rollers being proportioned to rollingly and compressingly engage a hose for positioning on the hose reel, whereby the hose is stripped of excess water and a maximum amount of hose can be stored in a minimized circular portion of the interior of the hose reel.

15. In the hose reel of claim 13 above, connecting means on both sides of the hose reel hub to removably receive the crank, whereby the crank may be positioned on either side of the body portion for use in confined spaces and to adapt itself to a user who is either left-handed or right-handed.

16. In the hose reel of claim 13 above, said guide means traversing the forward portion of the body being removable into a retracted configuration, said hub being secured in position interiorly of the body, and locking the same in place by means of a removably secured crank, whereby upon removing the crank and opening the guide means, the hose reel may be removed, and another hose reel inserted.

17. In the hose reel of claim 13, a spider assembly radiating from the reel hub, said assembly having two webs and a fitting crotch proportioned so that the web ends and the fitting crotch are on symmetrical centers, whereby the hose is secured in the crotch and wound to a circular configuration.

18. A hose reel comprising, in combination,
a body having two sides defining a reel pocket therebetween having a reel hub guide slot in one of said sides,
a reel having two opposed sides and a central hub with an extension at one end of the hub portion for insertion into the body side reel hub guide slot,
a crank,
means for securing the crank from a position adjacent one body side into the reel hub thereby securing the reel in the body reel pocket,
a hand grip portion on the body,
hose guide means on the body adjacent the reel,
whereby a hose may be wound around the reel hub and guided by the guide means.

19. In the hose reel of claim 18,
said guide means comprising a pair of opposed rollers in spaced relationship,
the space between the rollers being proportioned to rollingly and compressingly engage a hose for positioning on the hose reel,
whereby the hose is stripped of excess water and a maximum amount of hose can be stored in a minimized circular portion of the interior of the hose reel.

20. In the hose reel of claim 18 above,
connecting means on both sides of the hose reel hub to removably receive the crank,
whereby the crank may be positioned on either side of the body portion for use in confined spaces and to adapt itself to a user who is either left-handed or right-handed.

21. In the hose reel of claim 18 above,
said crank being removably secured to the reel central hub,
whereby removing the crank permits removing the reel.

22. In the hose reel of claim 18 above,
said guide means traversing the forward portion of the body being removable into a retracted configuration,
said hub being secured in position interiorly of the body, and locking the same in place by means of a removably secured crank,
whereby upon removing the crank and opening the guide means, the hose reel may be removed, and another hose reel inserted.

23. In the hose reel of claim 18,
a spider assembly radiating from the reel hub,
said assembly having two webs and a fitting crotch proportioned so that the web ends and the fitting are on symmetrical centers,
whereby the hose is secured in the crotch and wound to a circular configuration.

24. In the hose reel of claim 18,
said hand grip being at one end of the body,
said guide means being located at the end of the body remote from the hand grip,
said crank means being secured to the reel hub at a position between the grip and guide means.

25. A hose reel comprising, in combination,
a body having two elongate sides defining an uninterrupted top opening reel pocket laterally therebetween,
a reel having two opposed parallel side plates and a central hub,
a crank,
means for securing the crank from a position adjacent one body side into the reel hub thereby securing the reel in the body reel pocket,
a vertically aligned hand grip portion at one end of the body closing one end portion of the reel pocket,
hose guide means comprising upper and lower rollers at the end of the body remote from the hand grip and closing the other end portion of the reel pocket with said means for securing the crank positioned therebetween,
said hand grip, crank securing means, and hose guide means being all along a substantially straight line with the grasp axis of the hand grip perpendicular to said straight line,
said hose guide means including further means for retracting the upper roller for unwinding and removably securing the same in opposed squeezing relationship to the lower roller for rewinding the hose and expressing fluid therefrom,
whereby a hose may be wound around the reel hub and guided by the guide means, and readily unwound by releasing the upper roller and pulling the same along an axis the tension force of which is substantially coaxial with the axis of the hand grip, crank securing means, and the hose guide.

26. A hose reel comprising, a combination,
a reel having two opposed sides and a center reel hub with a crank receiving aperture,
a reel housing for receiving said reel,
said housing having opposed side walls of an essentially isosceles triangular configuration with uninterrupted top and bottom openings defined by said side walls to facilitate the ready placement in and removal of said reel into and out of said housing,
the base of said isosceles triangle forming hand grip means,
said hand grip means being aligned vertically substantially perpendicular to the median of said isosceles triangular sides,
the apex of said triangle forming hose guide means,
a mid portion of said triangle having a crank receiving opening,
said reel hub having an extension projecting from one end thereof,
one of said opposed side walls having a U-shaped reel hub extension receiving slot formed on an interior face thereof substantially centrally thereof so that said extension rotatably cradles within said slot and so that said reel is removed from said housing through said open top by lifting said reel and extension from said slot,
crank means for inserting in the crank receiving aperture causing said reel to rotate within said housing.

27. In the hose reel of claim 26,
the central portion of said hand grip, hose guide means, and crank means all forming a substantially straight line so that torque appearing at said hub when said reel is rotated within said housing is minimized and so that said torque is evenly distributed throughout said reel housing by reason of the substantially central disposition of said hub and by reason of said essentially isosceles triangular configuration of said housing.

* * * * *